US006960101B1

(12) United States Patent
Chen

(10) Patent No.: US 6,960,101 B1
(45) Date of Patent: Nov. 1, 2005

(54) STRUCTURE OF SIGNAL LINE CONNECTOR

(75) Inventor: Chiung-Ling Chen, Taipei (TW)

(73) Assignee: Cablenet Co., Ltd., Taipei (TW)

( * ) Notice: Subject to any disclaimer, the term of this patent is extended or adjusted under 35 U.S.C. 154(b) by 0 days.

(21) Appl. No.: 10/905,865

(22) Filed: Jan. 24, 2005

(51) Int. Cl.[7] ..... H01R 9/05
(52) U.S. Cl. ..... 439/578; 439/584
(58) Field of Search ..... 439/578, 584, 439/585, 583

(56) References Cited

U.S. PATENT DOCUMENTS 6,089,912 A * 7/2000 Tallis et al. ..... 439/584
6,425,782 B1 * 7/2002 Holland ..... 439/585
6,733,336 B1 * 5/2004 Montena et al. ..... 439/578
6,733,338 B1 * 5/2004 Hsia ..... 439/578
6,790,083 B1 * 9/2004 Chen ..... 439/583
6,805,584 B1 * 10/2004 Chen ..... 439/578

* cited by examiner

*Primary Examiner*—Briggitte R. Hammond

(57) ABSTRACT

A signal line connector includes a locknut, a hollow cylindrical casing, which has a coupling neck extended from one end thereof and fitted into the locknut, a locating barrel fitted into the other end of the casing, the locating barrel having a pressure collar and an outside annular flange extended around the periphery thereof for engaging into the hollow cylindrical casing to force the locating barrel to deform at an amount subject to the size of the signal line used, the pressure collar and the outside annular flange of the locating barrel having different outer diameters, and an outside annular groove defined between the pressure collar and the outside annular flange for buffering and compensating the deformation, and a center holding down tube mounted in the casing and secured to the locknut by the casing for holding down a tubular outer conductor and an outer insulative layer of a signal line against the inside wall of the locating barrel, keeping a center conductor of the signal line axially suspended in the locknut.

5 Claims, 9 Drawing Sheets

STRUCTURE OF SIGNAL LINE CONNECTOR

This application claims the priority benefit of Taiwan patent application number 093220049 filed on Dec. 13, 2004.

BACKGROUND OF THE INVENTION

1. Field of the Invention

The present invention relates to a signal line connector and, more specifically, to an improved structure of signal line connector, which has the locating barrel so made to fit different signal lines of different sizes and to maintain the sense of beauty of the outer appearance of the signal line connector intact after installation.

2. Description of the Related Art

A conventional signal line connector is known comprising a connector body affixed to a thin tube for accommodating a signal line. After insertion of a signal line into the connector body and the thin tube, a crimping device is used to crimp and distort the thin tube, causing the thin tube to be fixedly secured to the signal line. When crimping the thin tube, the thin tube may break along its seam line. Therefore, a contact error may occur, or the signal line may be separated from the signal line connector when the signal line stretched. There is also known a coaxial cable connector in which a socket is rotatably coupled to a hollow cylindrical casing and defines with the casing an annular space, and a locating member having an axially extended tapered hole is sleeved onto the rear extension of the barrel for squeezing the socket to hold down a coaxial cable. The installation procedure of this design is complicated. If the coaxial cable is curved or stretched during installation, the locating member tends to be vibrated and loosened, resulting in a contact error or disconnection of the coaxial cable.

FIGS. 7 and 8 show a signal line connector A according to the prior art, which is comprised of a locknut B, a center holding down tube C, a hollow cylindrical casing D, and a locating barrel E. The locknut B has an inner thread B1 in the rear end, and a coupling portion B2 in the front end. The center holding down tube C is coupled to the coupling portion B2 of the locknut B, having a tube body C3, a barbed portion C31 at the front end of the tube body C3, a receiving portion C2 at the rear end of the tube body C3, and a passage hole C1 axially extended through the receiving portion C2, the tube body C3 and the barbed portion C31. The hollow cylindrical casing D is mounted on the center holding down tube C, having a coupling neck D1 axially extended from the rear end, a rear coupling hole D2 and a front coupling hole D3 axially aligned in a line and respectively extended through the rear and front ends, and an inside annular groove D31 extended around the inside wall in the front coupling hole D3. The locating barrel E is plugged into the front coupling hole D3 of the hollow cylindrical casing D, having a receiving hole E1 axially extended through the front and rear ends, an inside annular flange E11 extended around the inside wall in the receiving hole E1, a first outside annular flange E21 around the rear end of a periphery E2, and a second outside annular flange E22 around a middle part of the periphery E2. During the assembly process, a gasket ring D4 is mounted on the coupling neck D1 of the hollow cylindrical casing D, and then the center holding down tube C is plugged into the rear end of the hollow cylindrical casing D to engage the receiving portion C2 in the rear coupling hole D2 of the coupling neck D1, and then the center holding down tube C is fastened with the coupling neck D1 of the hollow cylindrical casing D to the coupling portion B2 of the locknut B, and then the locating barrel E is plugged into the front coupling hole D3 of the hollow cylindrical casing D to engage the first outside annular flange E21 of the locating barrel E into the inside annular groove D31 of the hollow cylindrical casing D.

After installation of a signal line F in the locating barrel E and connection of the locating barrel E with the signal line F to the hollow cylindrical casing D (see also FIG. 9), this design of signal line connector shows drawbacks as follows:

- The periphery E2 of the locating barrel E is not greatly deformable to fit different signal lines F of different diameters, therefore a different size of locating barrel E shall be used to fit a different size of signal line F.
- When plugging the locating barrel E with the signal line F into the front coupling hole D3 of the hollow cylindrical casing D after installation of the signal line F in the locating barrel E, the periphery E2 of the locating barrel E is squeezed to deform (see FIG. 9), thereby causing the part of locating barrel E that extends out of the front coupling hole D3 of the hollow cylindrical casing D to curve. Curving of the protruded part of the locating barrel E destructs the sense of beauty of the signal line connector, and results in a gap between the inside wall of the hollow cylindrical casing D and the outside wall of the locating barrel E.

SUMMARY OF THE INVENTION

The present invention has been accomplished under the circumstances in view. It is therefore the main object of the present invention to provide an improved structure of signal line connector, which eliminates the drawbacks of the aforesaid prior art signal line connector.

To achieve this and other objects of the present invention, the invention improves the design of the locating barrel, i.e., in addition to the first and second outside annular flanges, the locating barrel further has a pressure collar extended around a periphery and spaced between the first outside annular flange and the second outside annular flange, and an outside annular groove extended around the periphery and defined between the pressure collar and the second outside annular flange. The pressure collar and the second outside annular flange have different outer diameters, so that the locating barrel can be properly deformed to fit different signal lines of different sizes. Further, the outside annular groove buffers and compensates the deformation of the pressure collar and the deformation of the second outside annular flange during installation of the locating barrel in the hollow cylindrical casing.

DETAILED DESCRIPTION OF THE PREFERRED EMBODIMENT

Figure 1:
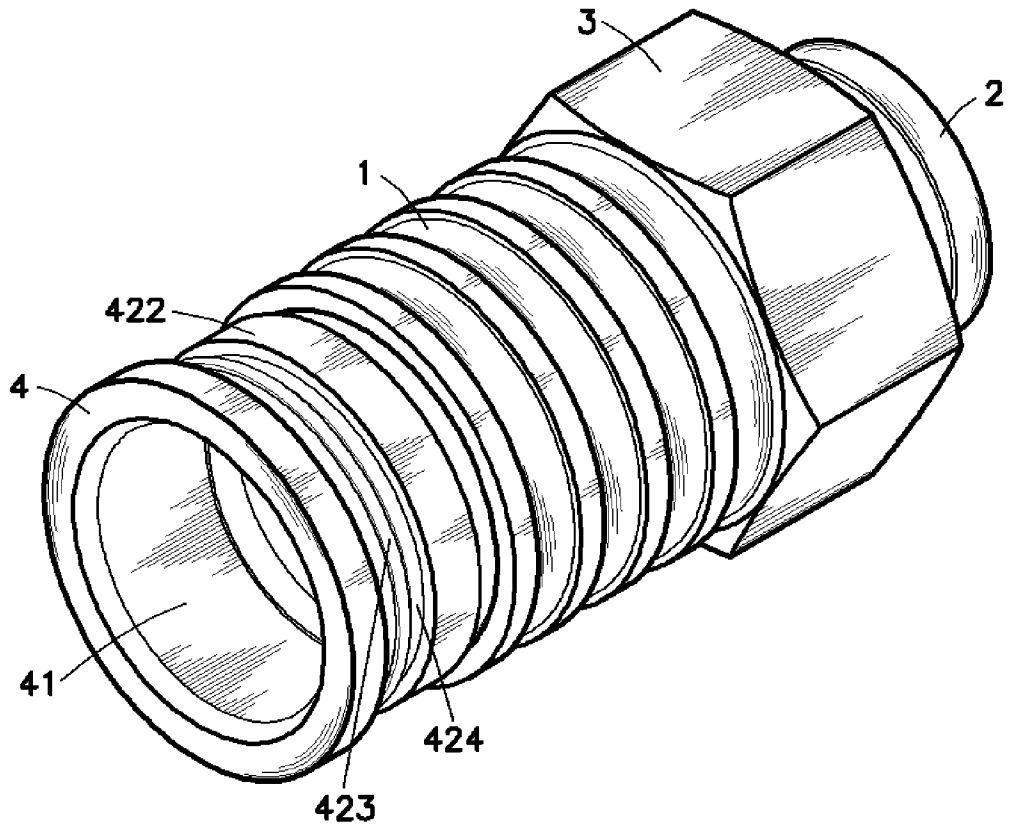
FIG. 1 is an elevational view of a signal line connector according to the present invention.
Figure 2:
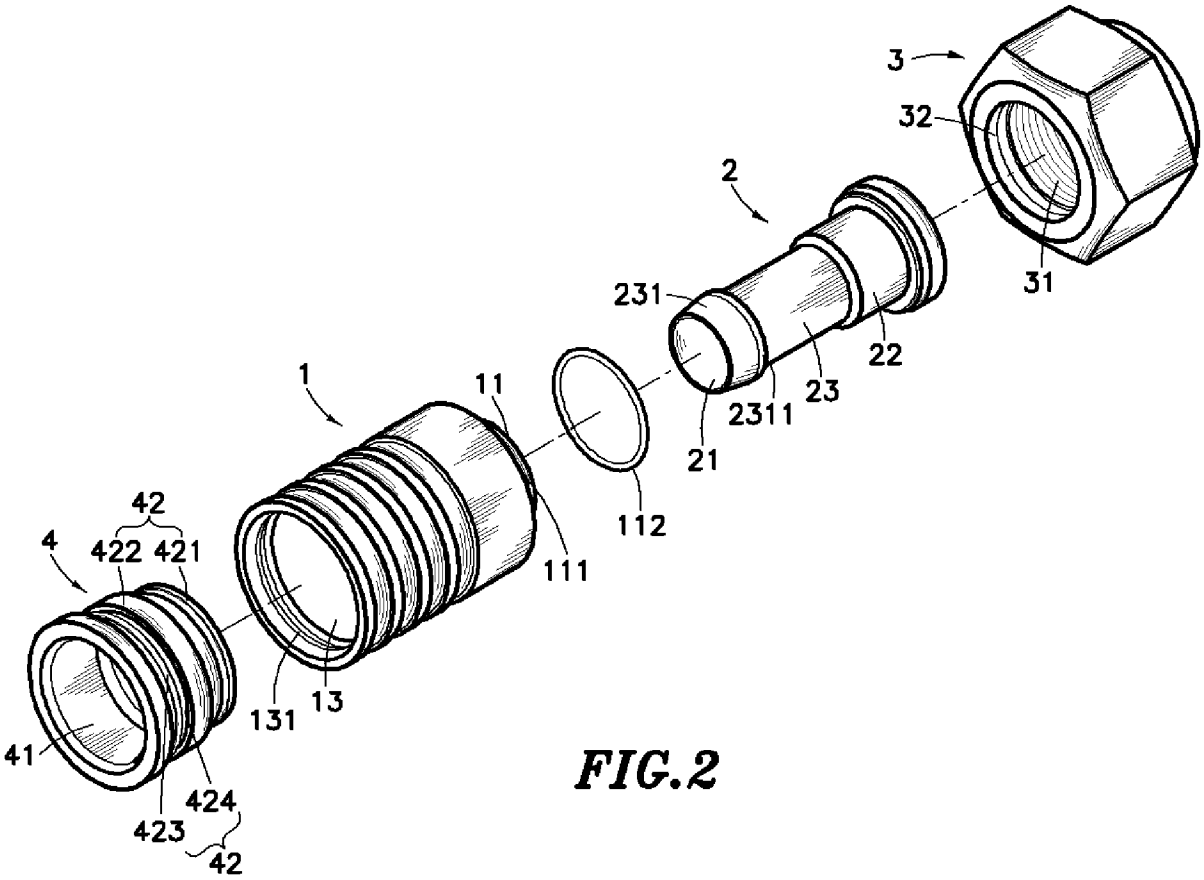
FIG. 2 is an exploded view of the signal line connector according to the present invention.
Figure 3:
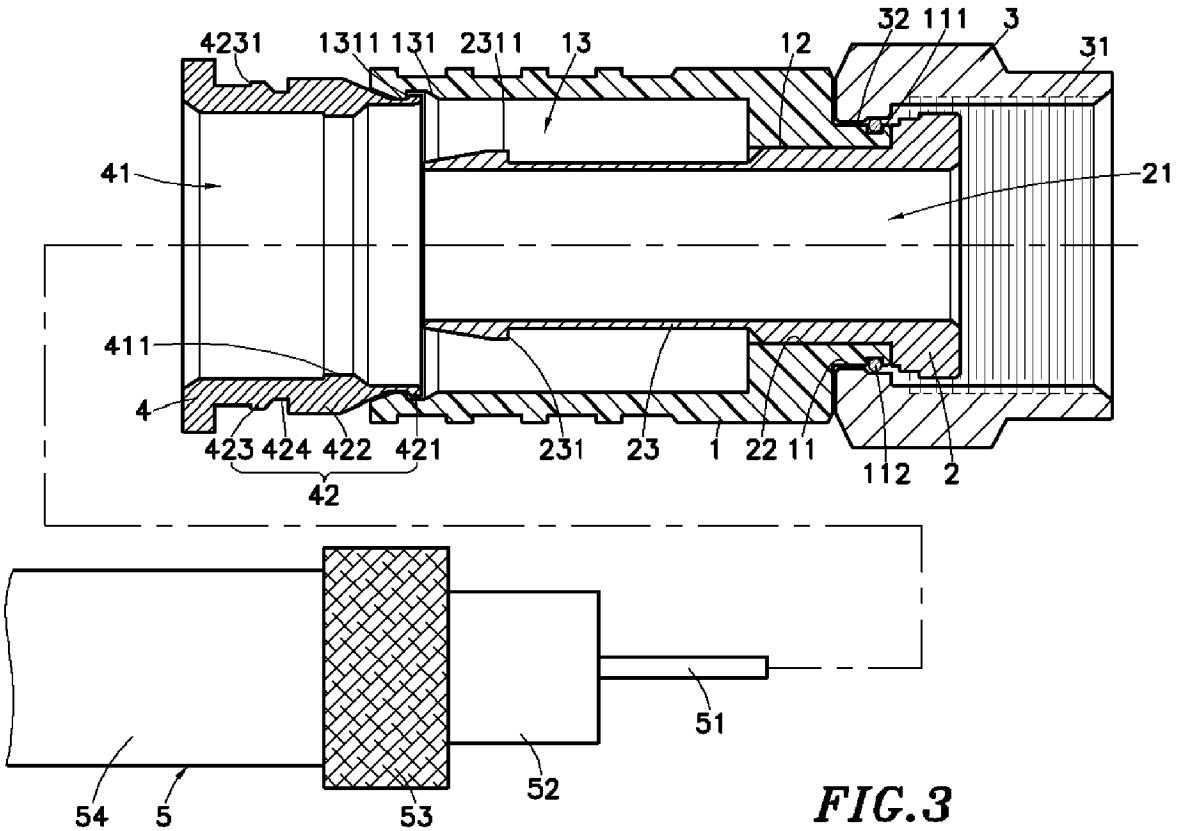
FIG. 3 is sectional view of the present invention before installation of the signal line.

Referring to FIGS. 1–3, a signal line connector in accordance with the present invention is shown comprised of a hollow cylindrical casing 1, a center holding down tube 2, a locknut 3, and a locating barrel 4.

The hollow cylindrical casing 1 is mounted on the center holding down tube 2, having a coupling neck 11 at the rear end, an outside annular groove 111 extended around the periphery of the coupling neck 11 to hold a gasket ring 112, a rear coupling hole 12 and a front coupling hole 13 axially aligned in a line and respectively extended through the rear and front ends, and an inside annular groove 131 extended around the inside wall in the front coupling hole 13, and an inside annular flange 1311 extended around the inside wall in the front coupling hole 13 at one side of the inside annular groove 131.

The center holding down tube 2 has a tube body 23, a barbed portion 231 at the front end of the tube body 23, a receiving portion 22 at the rear end of the tube body 23, and a passage hole 21 axially extended through the receiving portion 22, the tube body 23 and the barbed portion 231. The barbed portion 231 has a retaining plane 2311.

The locknut 3 has an inner thread 31 in one end, and a coupling portion 32 in the other end.

The locating barrel 4 has a receiving hole 41 axially extended through the front and rear ends, an inside annular flange 411 extended around the inside wall in the receiving hole 41, a first outside annular flange 421 extended around the periphery 42 near the rear end, a second outside annular flange 423 extended around the periphery 42 and spaced from the first outside annular flange 421 at a distance, a pressure collar 422 extended around the periphery 42 and spaced between the first outside annular flange 421 and the second outside annular flange 423 of the periphery 42, and an outside annular groove 424 extended around the periphery 42 and defined between the pressure collar 422 and the second outside annular flange 423. The pressure collar 422 and the second outside annular flange 423 have different outer diameters, i.e., the outer diameter of the pressure collar 422 is greater than the second outside annular flange 423. The second outside annular flange 423 has an outer side edge 4231 opposite to the outside annular groove 424. The outside annular groove 424 has one lateral side formed of a vertical wall and the other lateral side formed of a sloping wall.

During the assembly process, the receiving portion 22 of the center holding down tube 2 is plugged into the rear coupling hole 12 of the hollow cylindrical casing 1 to keep the tube body 23 and barbed portion 231 of the center holding down tube 2 through the front coupling hole 13 of the hollow cylindrical casing 1, and then the center holding down tube 2 is fastened with the coupling neck 11 of the hollow cylindrical casing 1 to the coupling portion 32 of the locknut 3, keeping the gasket ring 112 squeezed in between the coupling neck 11 of the hollow cylindrical casing 1 and the coupling portion 32 of the locknut 3 to prevent permeation of outside water into the signal line connector, and then the periphery 42 of the locating barrel 4 is plugged into the front coupling hole 13 of the hollow cylindrical casing 1 to force the first outside annular flange 421 of the locating barrel 4 into engagement with the inside annular groove 131 in the front coupling hole 13 of the hollow cylindrical casing 1.

Figure 4:
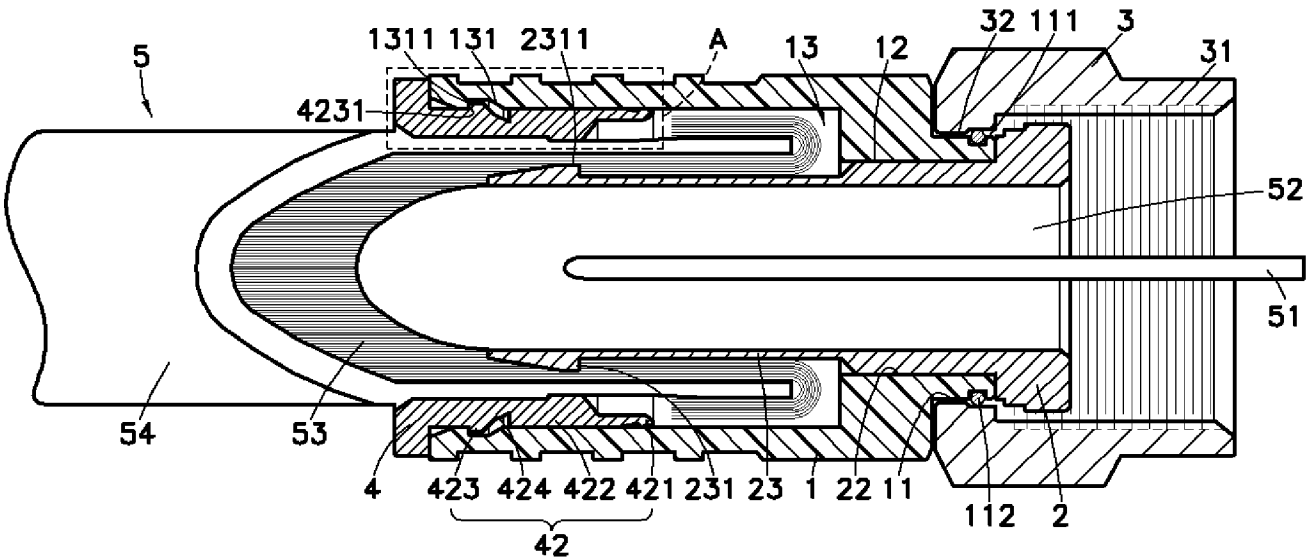
FIG. 4 is a sectional view of the present invention after installation of the signal line.
Figure 5:
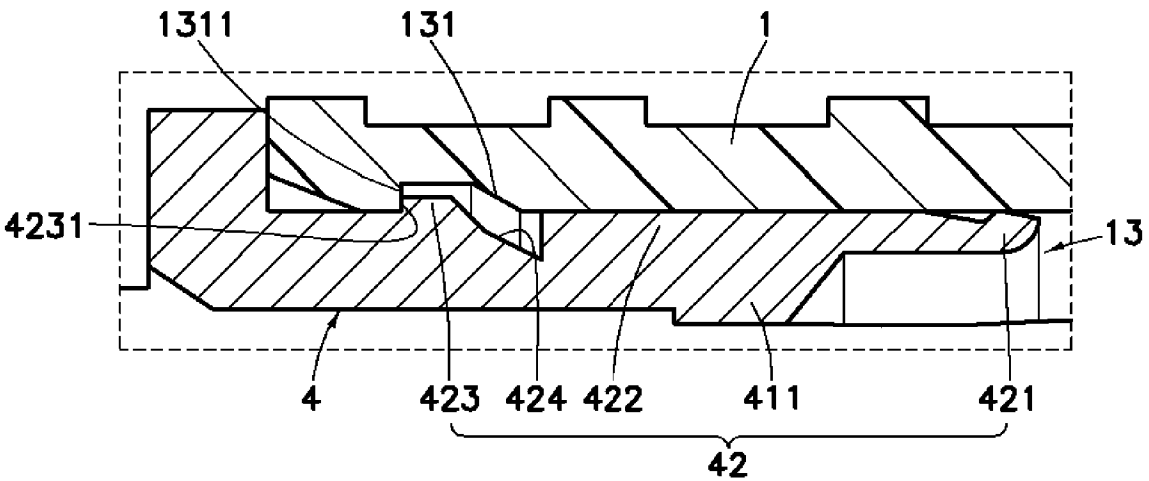
FIG. 5 is an enlarged view of part A of FIG. 4.

Referring to FIGS. 4 and 5 and FIG. 3 again, when connecting the signal line connector to a signal line 5, the signal line 5 is inserted through the receiving hole 41 of the locating barrel 4 to force an inner insulative layer 52 and a center conductor 51 of the signal line 5 into the passage hole 21 of the center holding down tube 2, causing a tubular outer conductor 53 and an outer insulative layer 54 of the signal line 5 to be jammed in between the barbed portion 231 of the center holding down tube 2 and the inside wall of the hollow cylindrical casing 1, and then the locating barrel 4 is pushed inwards toward the inside of the inner end of the front coupling hole 13 of the hollow cylindrical casing 1 to disengage the first outside annular flange 421 of the locating barrel 4 from the inside annular groove 131 of the hollow cylindrical casing 1 and to force the pressure collar 422 against the periphery of the front coupling hole 13 of the hollow cylindrical casing 1 and to further engage the second outside annular flange 423 of the locating barrel 4 into the inside annular groove 131 of the hollow cylindrical casing 1, keeping the outer side edge 4231 of the second outside annular flange 423 stopped against the inside annular flange 1311. At this time, the outside annular groove 424 is deformed to buffer the mount of deformation of the pressure collar 422 and the second outside annular flange 423, enabling the locating barrel 4 to be firmly secured to the front coupling hole 13 of the hollow cylindrical casing 1. Because the periphery 42 of the locating barrel 4 is radially inwardly compressed by the peripheral wall of the front coupling hole 13 of the hollow cylindrical casing 1 against the signal line 5 and the center holding down tube 2, the inside annular flange 411 of the locating barrel 4 and the barbed portion 231 of the center holding down tube 2 are forced to hold down the tubular outer conductor 53 and outer insulative layer 54 of the signal line 5 positively, and therefore the signal line 5 will not easily be pulled away from the locating barrel 4 and center holding down tube 2 of the signal line connector when stretched.

Figure 6:
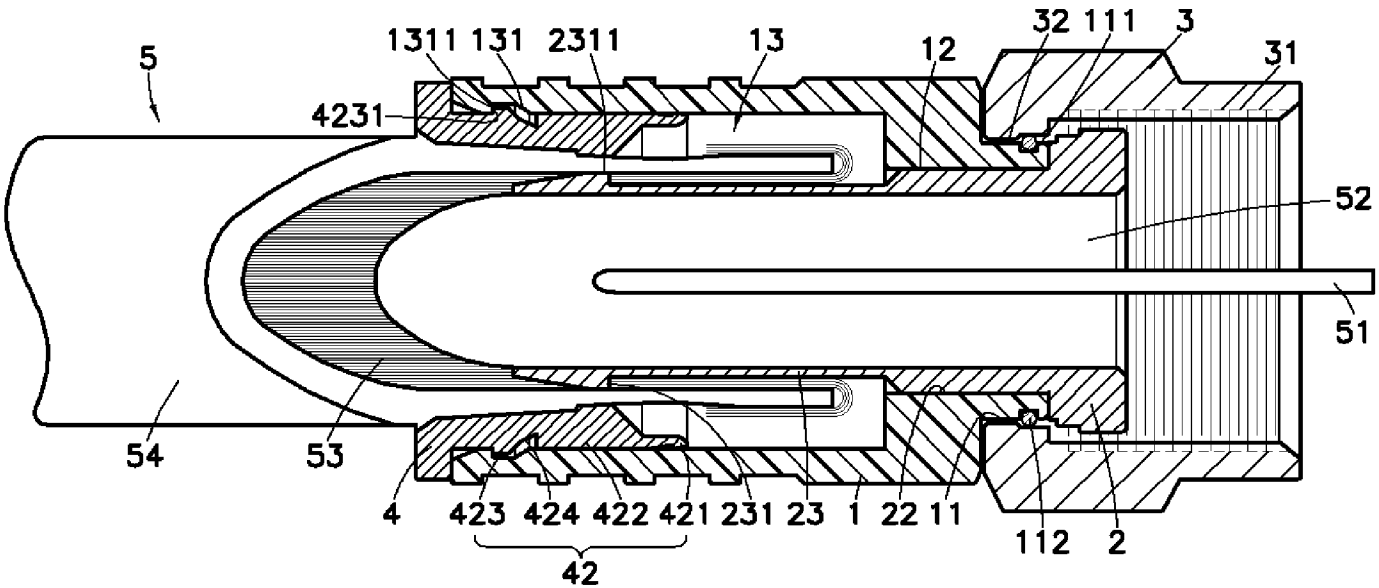
FIG. 6 is a side view in section of the present invention.
Figure 7:
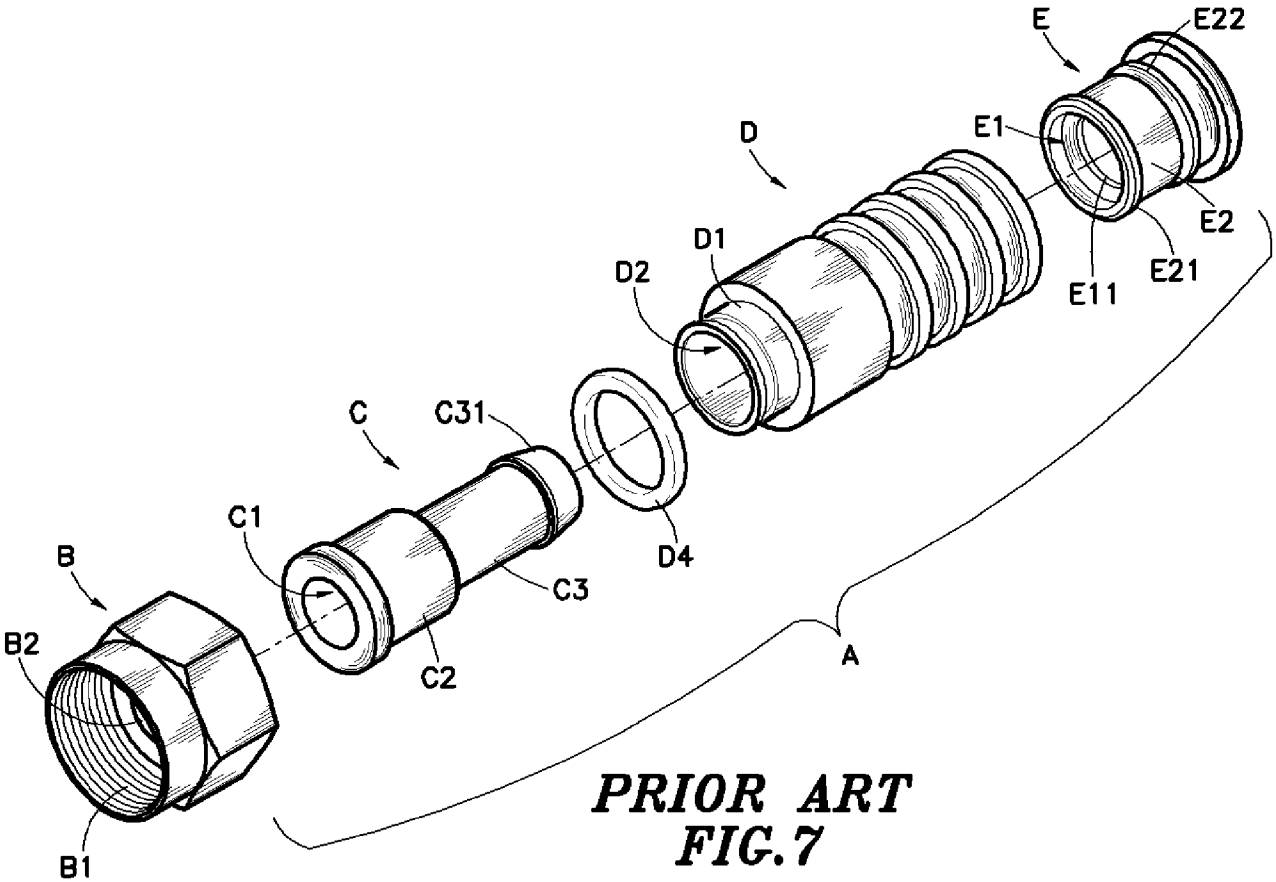
PRIOR ART FIG. 7
FIG. 7 is an exploded view of a signal line connector according to the prior art.
Figure 8:
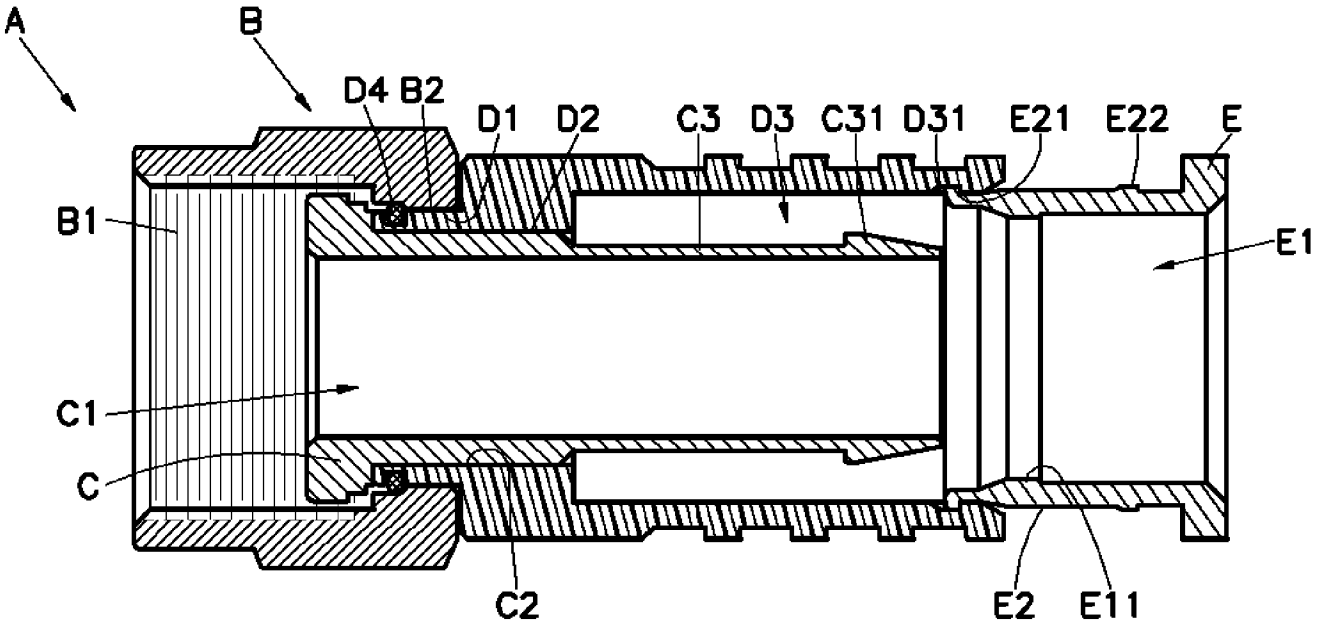
PRIOR ART FIG.8
FIG. 8 is a sectional side view of the signal line connector according to the prior art.
Figure 9:
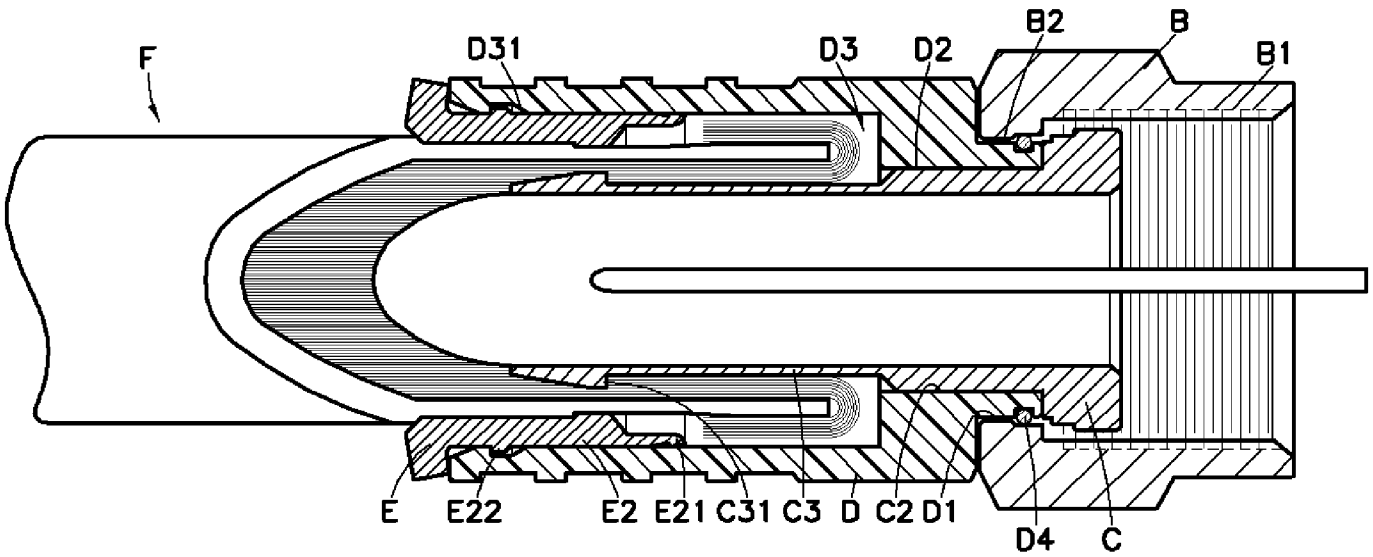
PRIOR ART FIG. 9
FIG. 9 is a sectional side view of the signal line connector after installation of a signal line.

Referring to FIG. 6 and FIGS. 4 and 5 again, the pressure collar 422 and the second outside annular flange 423 of the locating barrel 4 have different outer diameters, i.e., the outer diameter of the pressure collar 422 is greater than the second outside annular flange 423 so that the locating barrel 4 fits signal lines 5 of different sizes. When forcing the pressure collar 422 and the second outside annular flange 423 of the locating barrel 4 into the front coupling hole 13 of the hollow cylindrical casing 1, the pressure collar 422 is deformed at a relatively greater amount and the second outside annular flange 423 is deformed at a relatively smaller amount to prevent curving of the protruding part of the locating barrel 4 outside the hollow cylindrical casing 1, and therefore the locating barrel 4 and the hollow cylindrical casing 1 are kept in close contact with the signal line 5 without destructing the sense of beauty of the outer appearance of the signal line connector.

Further, the user can fasten the locating barrel 4 to the signal line 5 at first, and then insert the locating barrel 4 with the signal line 5 into the front coupling hole 13 of the hollow cylindrical casing 1. This installation procedure is simple and convenient.

As indicated above, the present invention provides a signal line connector, which has the advantages as follows:

1. The outer diameter of the pressure collar of the locating barrel is greater than the second outside annular flange and the locating barrel has an outside annular groove provided between the pressure collar and the second outside annular flange to buffer and compensate deformation of the pressure collar and deformation of the second outside annular flange during the assembly process of the signal line connector.

2. The pressure collar of the locating barrel is deformable at a great amount so that the locating barrel fits signal lines of different sizes and can be kept in close contact with the inside wall of the hollow cylindrical casing after its insertion into the hollow cylindrical casing.

3. The amount of deformation of the second outside annular flange is smaller than the pressure collar so that the protruding part of the locating barrel outside the hollow cylindrical casing does not curve and is kept tightly secured to the signal line without destructing the sense of beauty of the outer appearance of the signal line connector.

A prototype of signal line connector has been constructed with the features of FIGS. 1–6. The signal line connector functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A signal line connector comprising:

a locknut, said locknut having an inner thread in a first end thereof for threading onto an outer thread at a adapter and a coupling portion in a second end thereof;

a center holding down tube coupled to the coupling portion of said locknut, said center holding down tube comprising a tube body, a barbed portion at one end of said tube body, a receiving portion at an opposite end of said tube body, and a passage hole axially extended through the receiving portion, tube body and barbed portion of said center holding down tube;

a hollow cylindrical casing mounted to said center holding down tube, said hollow cylindrical casing comprising a coupling neck axially extended from a rear end thereof and press-fitted into the coupling portion of said locknut to hold down said center holding down tube, a rear coupling hole, which accommodates the receiving portion of said center holding down tube, a front coupling hole, and an inside annular groove in said front coupling hole; and a locating barrel plugged into the front coupling hole of said hollow cylindrical casing, said locating barrel comprising a first outside annular flange and a second outside annular flange respectively extended around the periphery thereof for selectively engaging the inside annular groove of said hollow cylindrical casing;

wherein said locating barrel further comprises a pressure collar extended around the periphery thereof and spaced between said first outside annular flange and said second outside annular flange, said pressure collar and said second outside annular flange having different outer diameters, and an outside annular groove extended around the periphery thereof and defined between said pressure collar and said second outside annular flange.

2. The signal line connector as claimed in claim 1, wherein the outer diameter of said pressure collar is greater than the outer diameter of said second outside annular flange.

3. The signal line connector as claimed in claim 1, wherein said locating barrel is detachable from said hollow cylindrical casing for use separately.

4. The signal line connector as claimed in claim 1, wherein said locating barrel comprises a receiving hole axially extended through two distal ends thereof and adapted to accommodate a signal line, and an inside annular flange extended around an inside wall thereof in said receiving hole and adapted to hold down a signal line in said receiving hole.

5. The signal line connector as claimed in claim 1, wherein said hollow cylindrical casing has an outside annular groove extended around said coupling neck and adapted to accommodate a gasket ring and to hold the gasket ring against the coupling portion of said locknut.

* * * * *